US005812966A

United States Patent [19]

Byun et al.

[11] Patent Number: 5,812,966

[45] Date of Patent: Sep. 22, 1998

[54] PITCH SEARCHING TIME REDUCING METHOD FOR CODE EXCITED LINEAR PREDICTION VOCODER USING LINE SPECTRAL PAIR

[75] Inventors: Kyung-Jin Byun; Hah-Yong Yoo; Ki-Chun Han; Jong-Jae Kim, all of Daejeon; Myung-Jin Bae, Seoul, all of Rep. of Korea

[73] Assignee: Electronics and Telecommunications Research Institute, Daejeon-shi, Rep. of Korea

[21] Appl. No.: 716,551

[22] Filed: Sep. 19, 1996

[30] Foreign Application Priority Data

Oct. 31, 1995 [KR] Rep. of Korea ..... 95-38772

[51] Int. Cl.[6] ..... G10L 3/02

[52] U.S. Cl. ..... 704/207; 704/209; 704/219

[58] Field of Search ..... 704/200, 217, 704/221, 229, 208, 207, 222, 216, 237, 241, 209, 219, 223

[56] References Cited

U.S. PATENT DOCUMENTS

| | | | |
|---|---|---|---|
| 4,282,406 | 8/1981 | Yato et al. | 704/207 |
| 5,233,660 | 8/1993 | Chen | 704/223 |
| 5,699,477 | 12/1997 | McCree | 704/216 |
| 5,710,863 | 1/1998 | Chen | 704/230 |

FOREIGN PATENT DOCUMENTS 0476614 3/1992 European Pat. Off. ..... G10L 9/18

OTHER PUBLICATIONS

Speech Classification Embedded in Adaptive Codebook Search for CELP Coding; Chih–Chung Kuo, Fu–Rong Jean and Hsiao–Chuan Wang; 1993; pp. II147–II150. ICASSP–93. 1993 IEEE International Transactions on Acoustics, Speech and Signal Processing. Apr. 1993.

*Primary Examiner*—Richemond Dorvil
*Attorney, Agent, or Firm*—Antonelli, Terry, Stout & Kraus, LLP

[57] ABSTRACT

An improved pitch searching time reducing method for a CELP vocoder using a Line Spectral Pair (LSP) frequency which is capable of significantly reducing the pitch search time by separating the speech signal using a first formant frequency of the line spectral pair of the digital type personal communication system, which includes the steps of computing a decimation interval of a pitch search interval using an LSP frequency of a first formant computed by a formant filter so as to compute a preparatory pitch of a given speech; determining a preparatory pitch to be used when searching a pitch by detecting a peak and a valley within each decimation interval; and computing a preparatory pitch by adapting a first formant frequency of an LSP computed by a formant filter with a decimation rate and performing a pitch search with respect to the obtained preparatory pitch.

2 Claims, 2 Drawing Sheets

PITCH SEARCHING TIME REDUCING METHOD FOR CODE EXCITED LINEAR PREDICTION VOCODER USING LINE SPECTRAL PAIR

BACKGROUND OF THE INVENTION

1. Field of the Invention

The present invention relates to a pitch searching time reducing method for a code excited linear prediction (CELP) vocoder using a line spectral pair (LSP), and more particularly to an improved code excited linear prediction coding method which is one of several vocoder techniques for mobile communication, and a personal communication system. This method is capable of reducing the pitch searching time of a entire vocoder process without the degradation of speech quality when enabling the CELP vocoder by adapting a component separation method to a pitch searching using the LSP.

2. Description of the Conventional Art

Generally, a personal communication system is directed to develop a speech coding device based on various vocoder theories so as to use a band width of a transmission channel efficiently and to achieve high speech quality of a digital type personal communication system.

These vocoder techniques can be classified into a waveform coding method, a source coding method, and a hybrid coding method.

Among the above techniques, the hybrid coding method is the most preferred method for vocoder implementation with respect to the audio quality and the bandwidth requirement.

Among the mixed coding vocoder techniques, the CELP vocoder is known to have the best speech quality in a given band width.

This CELP vocoder is directed to using a method of analyzing the speech signal input thereto, extracting desired parameters, combining the speech signal using the extracted parameter, comparing the combined signal with the input speech signal, and maintaining the best quality in the low transmission rate.

However, since the CELP vocoder uses a very complicated coding method described above, the real time of implementation requires a multitude of computations.

The processes of searching for an excited input signal from a codebook and computing the coefficients of the pitch filter requires the maximum amount of computations.

Among the above states, a process for obtaining information regarding the pitch cycle corresponding to the interrelationship of speech signals is similar to the concept of the present invention. Namely, since it accounts for more than 50% of the total computations of the CELP coder, the improvements of the same have a closer relationship with the entire coder.

There was introduced a patent titled "Speech coding and decoding system" (EP 0 476 614 A2, 1992. 3. 25. Japan) in the industry, which was basically directed to a method of reducing the computation amount by adapting a rarity type adaptive book which rarefied the pitch prediction residual signal in deciding the optimum pitch vector among the pitch vectors included in the adaptive codebook. However, the above-mentioned method is significantly different from the basic concept of the present invention.

In addition, there was introduced an article titled "Speech classification embedded in adaptive codebook search for CELP" (Proc. IEEE ICASSP, Vol. 2, pp 147–150, 1993) in the industry, which is directed to classifying a voice into four states: "Voiced, Voiced-unvoiced, unvoiced-voiced, and unvoiced" so as to restrict the search range of the pitch in accordance with each state.

In the case of a speech signal, when the pitch analyzing range is extended by a predetermined distance the speech quality is degraded. Therefore, it is necessary to minimize the computation amount by determining the range to be between 5 ms and 10 ms, thus preventing the degradation of the speech quality.

When computing a pitch delay "L" and a pitch gain "b" which are parameters of the common pitch filter in the case of the sampled speech signal of 8 KHz, a closed loop structure which has a quality speech is generally used. Here, the pitch delay is limited within the range from 20 to 147.

The pitch gain is obtained with respect to 128 delay values which are limited within the above-mentioned range, and an answer of the pitch filter with respect to the residual signal of the spectrum filter is obtained using the obtained pitch gain.

The average square difference value of the residual signal with respect to each case of the above is computed, and the pitch gain "b" and the pitch delay value "L" generating the minimum residual value are obtained, thus determining the optimum pitch filter.

In order to obtain the optimum pitch delay value and gain, since the computation with respect to the closed loop 128 times, there are a number of computations to obtain one pitch parameter value.

SUMMARY OF THE INVENTION

Accordingly, it is an object of the present invention to provide an improved pitch search algorithm for a CELP vocoder using an LSP which overcomes the problems encountered in the conventional pitch searching time reducing method.

It is another object of the present invention to provide a pitch search time reduction method for a CELP vocoder using an LSP which is capable of significantly reducing the pitch search time by separating the speech signal using a first formant frequency of the line spectral pair.

To achieve the above objects, there is provided a pitch search time reduction method for a CELP vocoder using an LSP, which includes the steps of computing a preparatory pitch of a given speech; determining a preparatory pitch to be used when searching a pitch by detecting a peak and a valley within each decimation interval; and computing a preparatory pitch by adapting a first formant frequency of an LSP computed by a formant filter with a decimation rate and performing a pitch search with respect to the obtained preparatory pitch. The decimation interval is obtained by an expression $D_1=F_1^{31\ 1}*\ 0.9$ when the number of one cycle samples $F_1^{-1}$ of the first formant frequency is greater than or equal to 23 sample values, and is obtained by an expression of $D_1=20$ when the number of one cycle samples $F_1^{-1}$ of the first formant frequency is smaller than 23 sample values.

Namely, the present invention is directed to a method for performing a preparatory pitch search by adapting the first formant frequency $\omega_2$ of the LSP as a decimation rate, and eliminating the other range of the sample when searching the pitch.

The present invention is directed to reducing the conventional pitch searching time by about 89%.

When implementing the vocoder technique using the digital signal processor (DSP), due to the large amount of the computation, it is difficult to perform the computation at a real time if a high speed DSP chip is not used. However, since the present invention can use other functions as much as the reduced amount of the computation using the DSP chip, it is easy to implement the computation at a real time due to the improved pitch search.

Additional advantages, objects and other features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
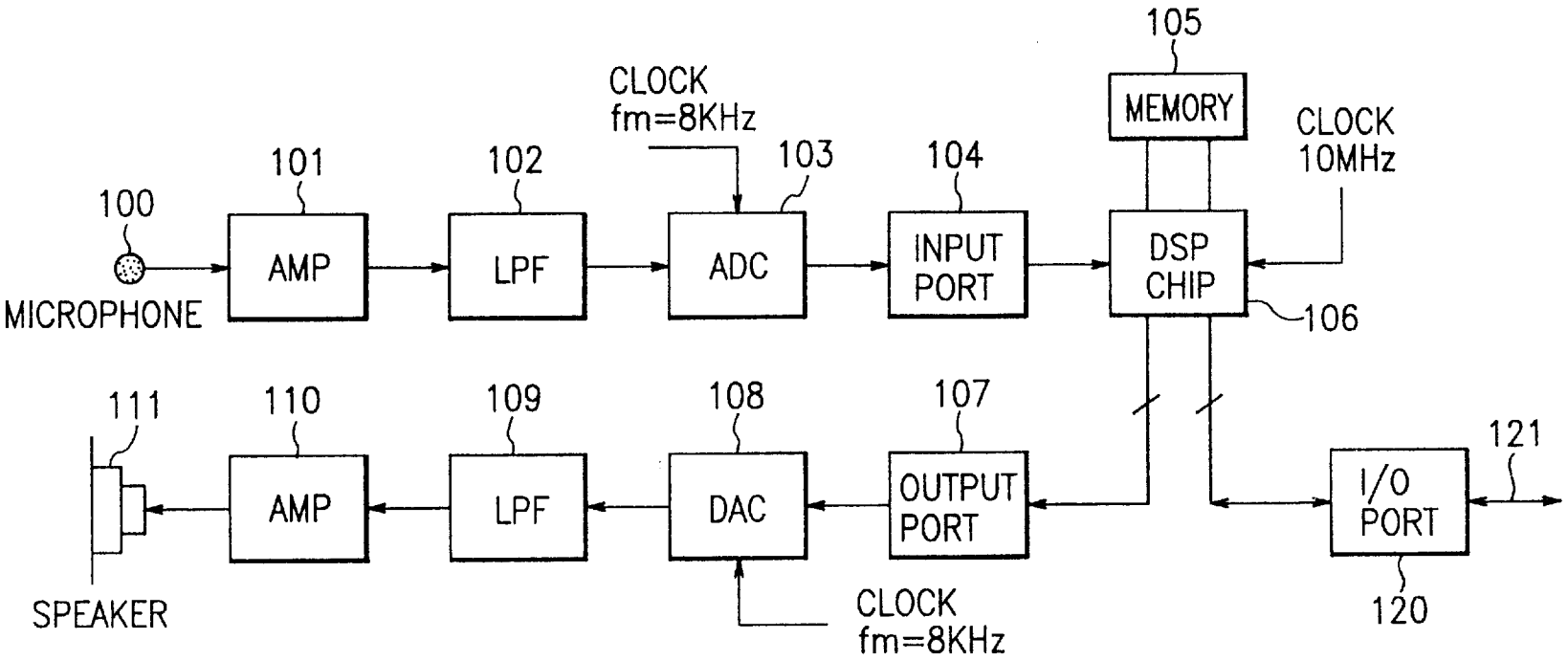
FIG. 1 is a block diagram of the construction of hardware according to the present invention.

FIG. 1 shows the hardware construction according to the present invention, which is referred to in a speech signal processing system.

As shown therein, a speech wave is converted into an electrical signal by a microphone 100, and is then amplified by an amplifier 101 up to a predetermined level. When the component of the signal input from the microphone 100 is a speech signal, it has a frequency ranging from 20 Hz to 20 KHz.

In order to implement the objects of the present invention, since the minimum bandwidth for intelligible speech is between 3 KHz and 4 KHz, the frequency component higher than 4 KHz is eliminated by a low-path filter 102. The reason for the elimination of the same is to reduce the amount of data to be processed per second when converting the speech signal into a digital signal.

In order to leave the signal component lower than 4 KHz and process the signal of which the low-pass component is filtered using the computer, the signal should be converted into a digital signal. This is sampled by an analog/digital converter 103 which is directed to convert the analog signal into the digital signal.

The rate of the sample is 8 KHz which is double the maximum frequency (here, it is referred to 4 KHz) in accordance with the Nyquist sampling theory.

In addition, the voltage level per sample is quantumized, and for the standard of the phone quality, 12 bits ($2^{12}$=4096) resolation is used.

The processed digital speech signal is input into an input port 104 for the computation and processing.

The speech signal data is processed through a software processing step, and is then stored into a memory 105 or is output to an input/output port 120 for a transmission to a transmission channel 121.

In addition, the speech signal is combined with a decoding process using the data read from the memory 105 or the input data through the transmission channel 121.

The combined speech signal which is decoded by the microprocessor is transferred to an output port 107 so as to check whether the combined speech signal is processed using a speaker 111.

When the data is transferred to the output port, this data is transferred to a digital/analog converter 108 which converts a digital signal into an analog signal.

In this case, the signal is converted into an analog value of 8 KHz at the sample rate.

Since the converted signal appears as an individual signal in which a high frequency of a sample rate is contained, the signal is processed by the low-band filter 109 in order for only a basic band signal to remain. The thusly processed signal is amplified and then output to the speaker 111.

Since the speaker 111 converts the electrical signal into an speech pressure wave, the signal becomes audible to human ears.

Figure 2:
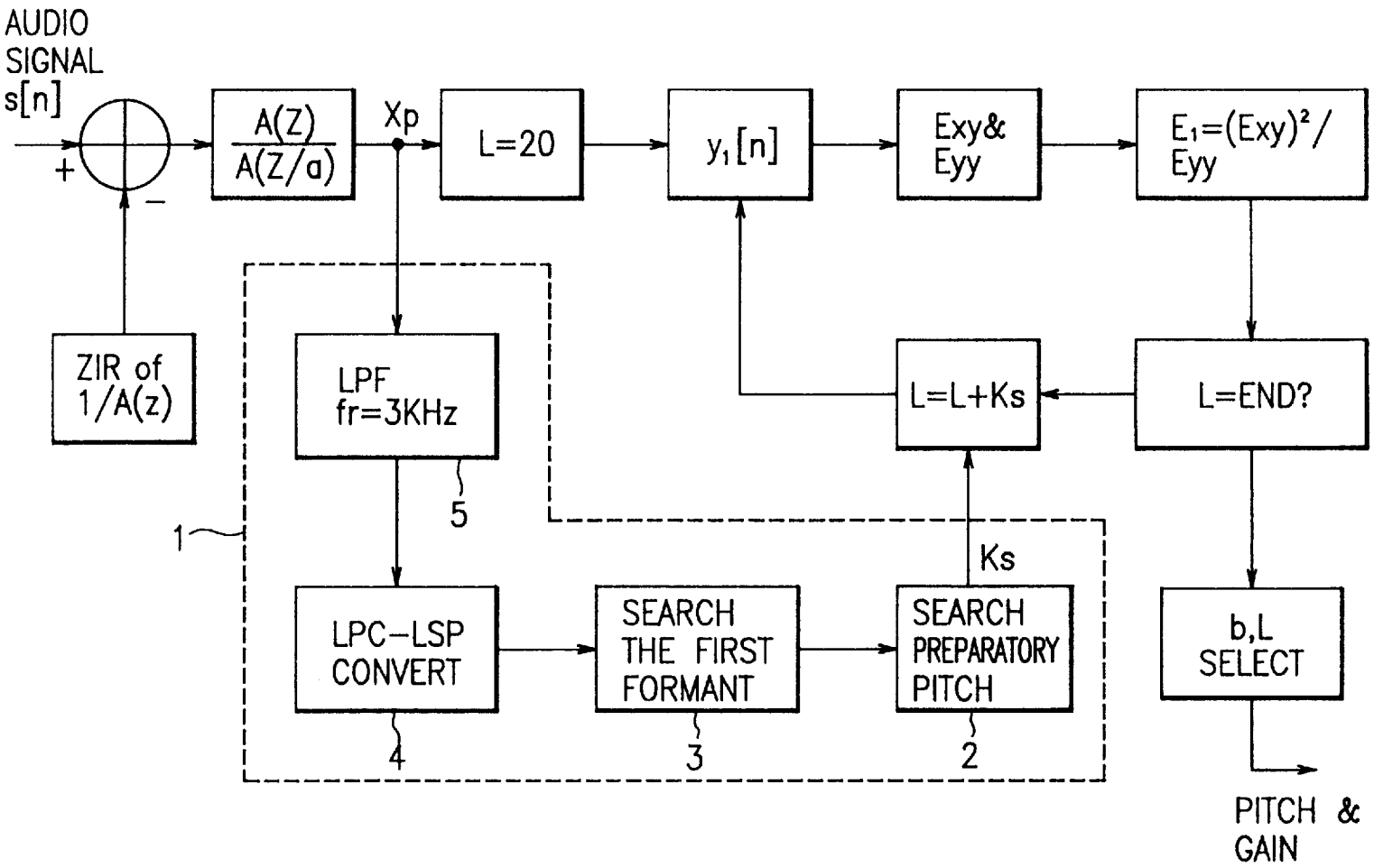
FIG. 2 is a flow chart of a pitch search of a CELP vocoder using an LSP according to the present invention.

The pitch search process according to the present invention will now be explained with reference to FIG. 2.

As shown therein, the portion indicated by the dotted line of the entire pitch search portion refers to the novel elements of the present invention.

In the conventional art, there are provided elements except for the portion indicated by the dotted line. Namely, the conventional art is directed to increasing the pitch delay value "L" from 10 to 147 by one, and the value having a minimum error is determined as a pitch delay value "L".

However, the present invention includes the elements indicated by the dotted line so as to adapt $\omega_2$ of $F_1$ (a first formant) of the LSP as a decimation rate by newly inserting the functions of the elements, and then the preparatory pitch is obtained using the above. Thereafter, the pitch search is performed using the results of the above-mentioned process.

As shown in FIG. 1, the portion "L=L+Ks" among the closed loop is "L=L+1" in the conventional art, so 128 closed loops are performed. However, in the present invention, the closed loop is performed except for the decimation interval.

In speech, the energy of the first formant $F_1$ is higher than other formants by about 10 dB.

Since the formants have a band-width, a decreasing vibration is obtained within one pitch of the time region.

In the speech wave, since the wave is sampled at 8 KHz, the number of samples $F_0^{-1}$ of the possible fundamental frequency is between 20 and 200, and the number of samples $F_1^{-1}$ of the first formant frequency is between 10.6 and 32, the pitch search are performed with respect to the representive value indicating the pitch cycle at every minimum 20 samples.

The representive value representing the pitch cycle can be obtained at 20 samples which is the minimum pitch interval, however since $F_1$ may be equal to or higher than $F_0$, the line spectrum frequency of $F_1$ with respect to the wave is obtained. With this value, the representive preparatory pitch may be obtained.

So as to obtain the preparatory pitch of the given speech, the decimation interval $D_1$ of the pitch search interval is obtained using the LSP frequency $\omega_2$ of the first formant.

$$D_I = 20,\ F_I^{-1} < 23 \qquad (1)$$
$$D_I = F_I^{-1} * 0.9\ F_I^{-1} > 23$$

To begin with, one frame is divided into units $D_I$, and the units $D_I$ are given interval numbers "i".

Here, the size of the maximum peak with respect to the "i"th interval $D_I$ is stored in the p(i, 1), and the position of the sample is stored in the position p(i, 0).

In addition, the minimum valley is computed, and the height and position of the sample are stored at the v(i, 1) and v(i, 0).

The preparatory pitch may have a sample information error due to the phase variation of the third formant of the speech signal when the peak and valley are searched.

Therefore, the following Hanning filtering expression is performed with respect to the speech signal, and then the decimation is performed, thus eliminating effects by the high order formant.

$$s'(n-2)=(s(n)+2s(n-1)+3s(n-2)+2s(n-3)+s(n-4))/9 \quad (2)$$

where the cutoff frequency of the Hanning filter is 2.67 KHz.

So as to use the searched peak and valley as a preparatory pitch, when the difference of the next peak (valley) based on the reference of the searched peak (valley) is within the following interval, the relationship is fully performed.

$$Tp(2i)=p\%(i,\ 0)-T_{hp},\ \text{and}$$

$$Tp(2i+1)=v\%(i,\ 0)-T_{hv},\ i=1,\ 2,\ \ldots,\ 12 \quad (3)$$

where $T_{hp}$ denotes the position of the first peak, and $T_{hv}$ denotes the position of the first valley.

The Tp(i) having the maximum E(Tp(i)) is determined as the pitch value "L" of the pitch filter by inserting into the relationship expression "$E(L)=Exy^2/Eyy$" with respect to the combination of the searched preparatory pitch, and the coefficient of the pitch filter is determined as follows.

$$b = Exy/Eyy = \frac{\sum_{n=0}^{M-1} (s(n)s(n-L))}{\sum_{n=0}^{M-1} (s(n-L)s(n-L))} \quad (4)$$

M is the subframe length. When the decimation is performed, the numbers of the peaks and valleys are detected with respect to one per the sample $D_I$. The pitch search time when the preparatory pitch interval is searched in consideration of the interval of the peak and valley is shortened as compared to the standard serial pitch search method.

$$Tr:2/D_I{}^*\ 105<10.5\% \quad (5)$$

wherein when 5% is added to the computation time is referred to as the time for performing the decimation.

The average search time of one second with respect to the various speech so as to obtain the pitch search time difference of the two processing steps is obtained as follows.

The conventional serial pitch search method needs 7.52 seconds in average, and the method according to the present invention needs 0.83 seconds in average, thus achieving a time savings of about 89%.

Here, since the time measuring differs for the type of the computer, the relative time reducing rate is considered.

Meanwhile, the prediction gain of the pitch filter in the suggested search method as compared to the serial pitch detection is lowered down to average 10.82 dB from average 11.65 dB. Namely, the quality is degraded by −0.83 dB.

As described above, when adapting the first formant of the LSP with the decimation rate, the pitch search time can be reduced by 89% without the degrading the speech quality when implementing the CELP vocoder, so that it is possible to implement the CELP vocoder at real time using low price DSP chip which has a lower processing speed.

In addition, since the computations which are reduced in the pitch search process may be used for another service function, it is possible to design the more economic CELP vocoder system.

Since the processing time of the vocoder directly affects the power consumption, the time for using the vocoder adapted to the personal communication system can be extended, thus improving the quality of the product.

Although the preferred embodiments of the present invention have been disclosed for illustrative purposes, those skilled in the art will appreciate that various modifications, additions and substitutions are possible, without departing from the scope and spirit of the invention as described in the accompanying claims.

What is claimed is:

1. A method for searching a pitch in a CELP coding method, said method comprising the steps of:

computing a decimation interval of a pitch search interval using a Line Spectral Pair (LSP) frequency of a first formant computed by a formant filter so as to compute a preparatory pitch of a given speech;

determining a preparatory pitch to be used when searching a pitch by detecting a peak and a valley within each decimation interval; and computing a preparatory pitch by adapting a first formant frequency of an LSP computed by a formant filter with a decimation rate and performing a pitch search with respect to the obtained preparatory pitch.

2. The method of claim 1, wherein said decimation interval is obtained by an expression $D_1=F_1^{-1}*0.9$ when the number of one period samples $F_1^{-1}$ of the first formant frequency is greater than or equal to 23 sample values, and is obtained by an expression of $D_I=20$ when the number of one period samples $F_1^{-1}$ of the first formant frequency is smaller than 23 sample values.

* * * * *